United States Patent [19]

Kress

[11] 4,198,779

[45] Apr. 22, 1980

[54] MODEL AIRCRAFT PROPULSION SYSTEM

[76] Inventor: Robert W. Kress, 27 Mill Rd., Lloyd Harbor, N.Y. 11746

[21] Appl. No.: 916,343

[22] Filed: Jun. 19, 1978

[51] Int. Cl.[2] ..... A63H 27/00

[52] U.S. Cl. ..... 46/78

[58] Field of Search ..... 46/78, 76 R, 77, 75, 46/249, 248; 74/89, 22, 230.01, 226, 225, 665.6 E

[56] References Cited

U.S. PATENT DOCUMENTS

| | | | |
|---|---|---|---|
| 1,403,595 | 1/1922 | Dykas | 46/75 |
| 2,860,447 | 11/1958 | Müller et al. | 46/78 |
| 3,229,416 | 1/1966 | Bross | 46/78 |
| 3,618,259 | 11/1971 | Voorhis | 46/249 |

*Primary Examiner*—Russell R. Kinsey
*Assistant Examiner*—Michael J. Foycik, Jr.

[57] ABSTRACT

A multi-propeller propulsion system for model aircraft having a single engine and positive driving connections between the engine and each of the multiplicity of propellers. The positive drive may include toothed pulleys and serrated belts and gearing for example.

2 Claims, 5 Drawing Figures

MODEL AIRCRAFT PROPULSION SYSTEM

FIELD OF INVENTION

The present invention relates to model aircraft and has particular reference to multi-propeller propulsion means therefor.

BACKGROUND

Prior practice in model aircraft with multiple propellers has been to use a separate engine for each propeller, resulting in a complex system with many operational difficulties. Primarily the multiple engines are not easy to start, tune and get running properly all at the same time. If one engine fails in flight the model aircraft is likely to go out of control in the hands of any but the most skillful and experienced hobbyist, suffering considerable and costly damage. In the present invention the multiplicity of propellers are driven by a single engine through a system of pulleys, belts, and gears so that the model operates similarly to the familiar single engine aircraft. Now if the engine fails in flight even the neophyte modeler can guide the aircraft to a safe landing. For added realism, the propellers on one side of the aircraft can be made to turn clockwise and on the other side to turn counterclockwise through reversing gearing, if desired.

DRAWINGS

For a more complete understanding of the invention, reference may be had to the accompanying diagrams in which.

DESCRIPTION

Figure 1:
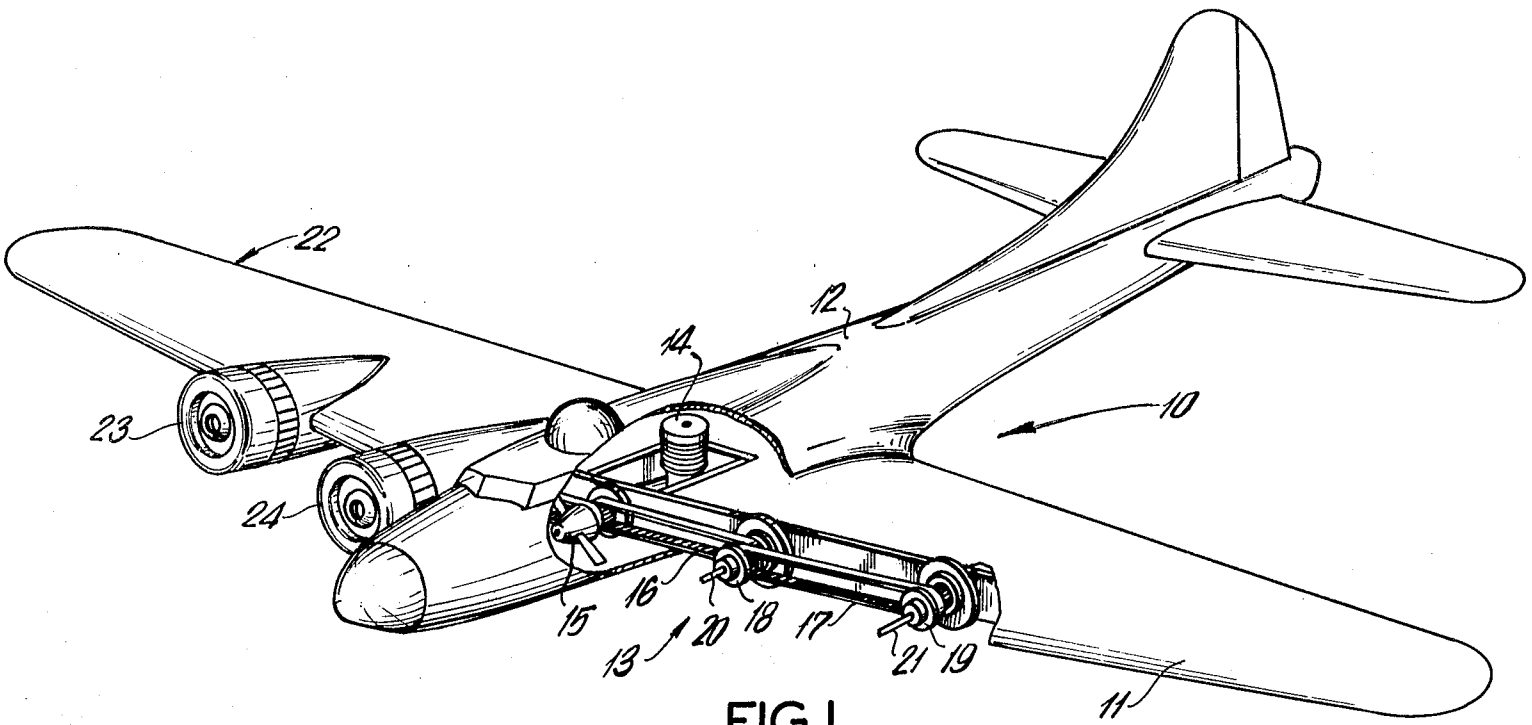
FIG. 1 shows a typical four engine propeller driven model aircraft.
Figure 2:
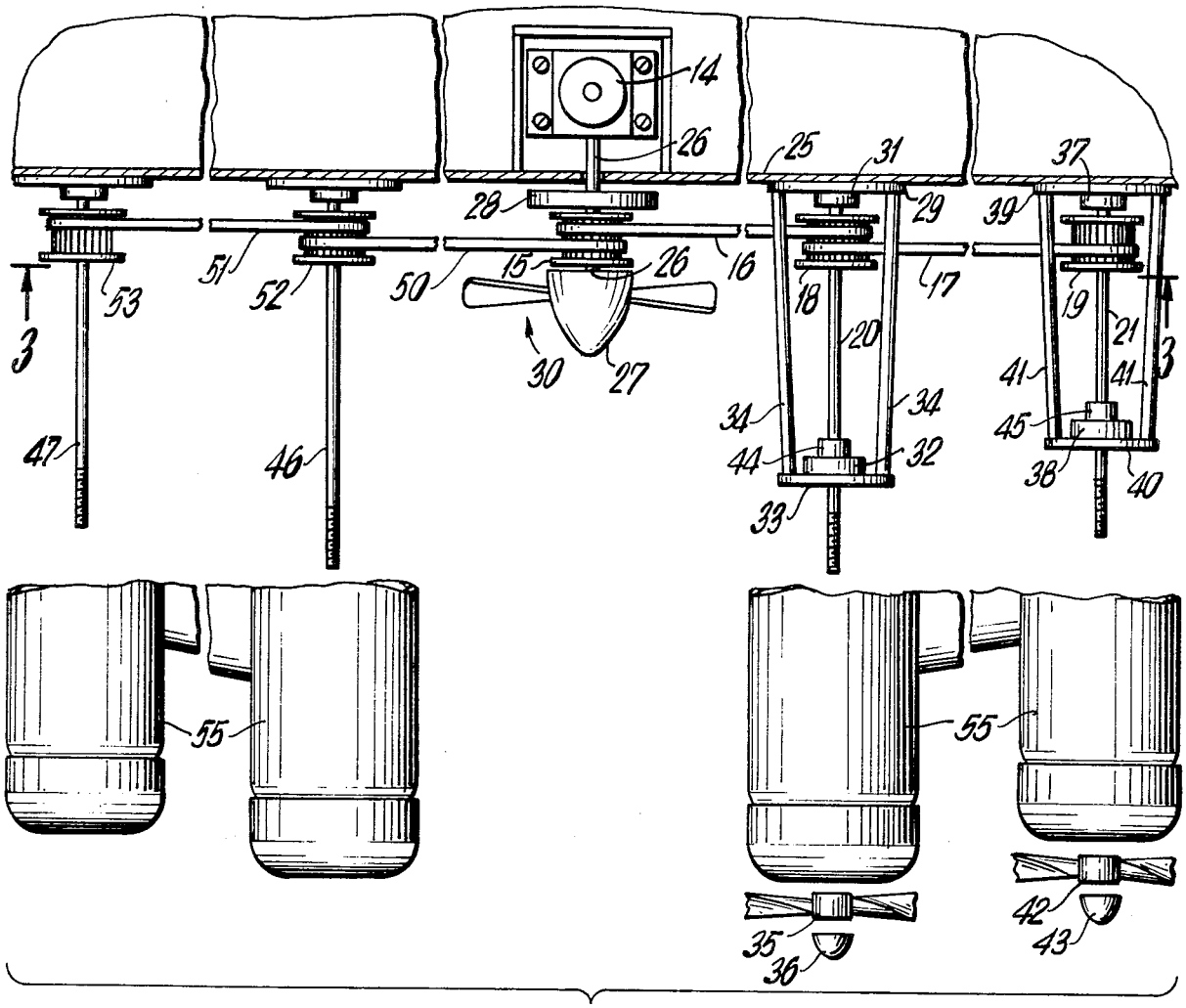
FIG. 2 shows the propulsion system of the aircraft of FIG. 1 in more detail.
Figure 3:
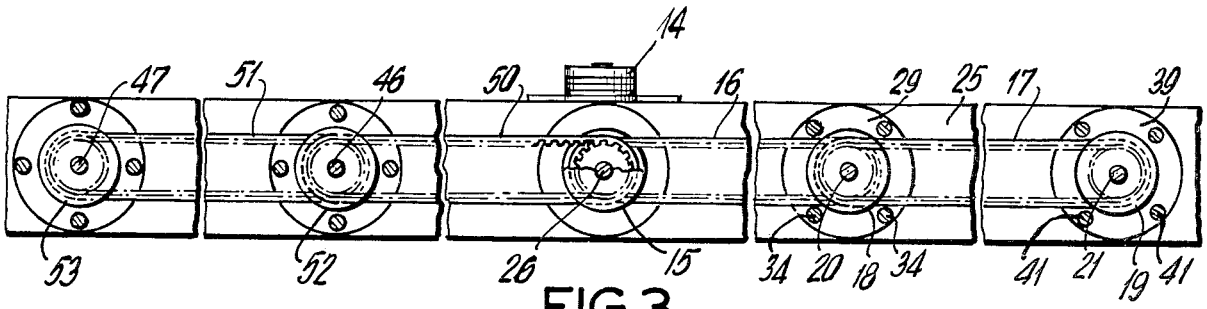
FIG. 3 is a view of FIG. 2 from the front of the aircraft.

With reference now to FIG. 1 there is shown a pictorial view of a four engine model aircraft 10 in which the left wing 11 and fuselage 12 are partly broken away to reveal a portion of the new propulsion system 13. It will be seen that the engine 14 drives pulley 15 directly and through a system of belts 16, 17 and pulleys 18, 19 drives the propeller shafts 20, 21. A similar arrangement of pulleys and belts in the right wing 22 (see FIG. 2 and 3) drives the propellers of the right hand propulsion means 23 and 24. FIG. 2 is a top view (compressed sidewise due to space limitations) and FIG. 3 is a forward view of the complete propulsion system 13 driving both the right and left side propellers. As seen in FIG. 2 the engine 14 is mounted on transverse wing beam 25, with its shaft 26 protruding through beam 25. Carried on shaft 26 are a flywheel 28, pulley 15 and an air circulating fan 30 and a spinner 27 for engine starter engagement. Preferably, the shaft 26 is substantially on the centerline of the aircraft.

Propeller shaft 20 is journalled on one end in bearing 31 held in plate 29, which is secured to beam 25, and on the other end in thrust bearing 32 held in plate 33. Supports 34 span the space between the plates 29 and 33, and hold the plate 33 in fixed position. The toothed pulley 18 is attached to shaft 20 within the supports 34. The outer end of shaft 20 is threaded and shaped to accept the hub 35 of a propeller and a nut 36 to hold it in place. Propeller shaft 21, similarly journalled in bearings 37, 38 on plates 39, 40 respectively, carries the toothed pulley 19. Supports 41 hold the plate 40, and the outer end of shaft 21 is adapted to accept the propeller hub 42 and nut 43, The cowlings 54 are slipped over supports 41 and attached to the wing, with the end of shafts 20, 21 protruding therethrough. Serrated belt 16 extends around pulleys 15 and 18, driving shaft 20 and propeller hub 35, while serrated belt 17 over pulleys 18 and 19 drives shaft 21 and hence propeller hub 42 thereon.

Shafts 20 and 21 are also provided with collars 44 and 45 at the bearings 32 and 38 which prevent outward movement of the shafts 20, 21. A ball thrust bearing may also be used between collar 44 and bearing 32 if desired. When the belts 16, 17 need replacement, the collars 44, 45 are loosened to permit shafts 20, 21 to be taken out of bearings 31, 37 and the new belts slipped over the pulleys 18 and 19. Should any of the supports 34 or 41 be within the belt loop (as shown on the left of FIG. 3) they too must be capable of disassembly to permit replacement of the belts.

The basic system just described is repeated for the right hand propellers (on the left of FIG. 2) where shafts 46 and 47 are driven by belts 50, 51 and pulleys 52, 53.

Figure 4:
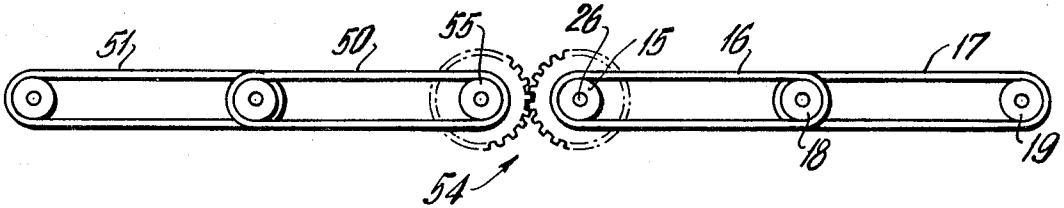
FIG. 4 is an alternative arrangement of FIG. 3.

All of the propeller shafts in FIG. 3 are driven in the same direction, e.g. clockwise. If counter rotation on one side of the aircraft is desired, a reversing gear set 54 (FIG. 4) may be inserted between engine shaft 26 and an intermediate pulley 55. The counter rotating propellers may be desirable for scale simulation or to reduce propeller net torque on the aircraft to zero, or to make the airflow over the model symmetrical right to left.

Figure 5:
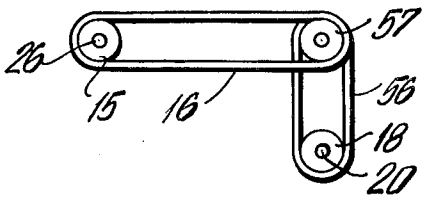
FIG. 5 is another alternative of FIG. 3.

It will also be recognized that while the figures show a system where the thrust centerline passes essentially through the wing the thrust centerline may be above or below the wing in other models. If the offset is so large that a simple angular displacement of driving and driven shafts cannot be made within the model envelope, an idler pulley and belt or gears may have to be provided as outlined in FIG. 5. Here the shaft 20 is below the engine shaft 26, so that an idler pulley 57 is driven by belt 16, and shaft 20 is driven by belt 56.

It will be understood that many changes from the example described are possible. Six or more propellers could be driven this way. The engine may be mounted in any desired position: upright as shown facing forward; or facing aft; inverted, facing forward or aft; or on its side. The engine and propeller shafts are shown essentially parallel, but the engine shaft could be skewed for some starting configurations. In this case the inboard belts are twisted.

The fan for cooling the engine draws air through internal passages not shown but whose necessity will be recognized. Alternatively, the fan tip protrudes through the model belly and blows over the cylinder head of an inverted engine with the head external. The propellers can be geared up or down with selected pulley sizes. A recent trend is to geared down propellers for larger, slower models and more low speed thrust for large models.

I claim:

1. Multipropeller propulsion means for model aircraft comprising an engine mounted on said aircraft, a plurality of propellers on said aircraft, positive synchronous drive means between said engine and said propellers including a toothed pulley driven by said engine, a plurality of toothed driving pulleys, each propeller operatively connected to a corresponding toothed driving pulley, and toothed belt means between said toothed driven pulley and said toothed driving pulleys for positively rotating said propellers in unison.

2. The propulsion system of claim 1 including a second toothed pulley driven by said engine, rotation reversing means between said engine and said second driven toothed pulley, wherein said toothed belt means is between said first driven pulley and said driving pulleys on one side of said aircraft, and the toothed belt means on the other side of the aircraft is between the driving pulleys on the other side of said aircraft and the second driven pulley whereby the propellers on one side of the aircraft rotate in a direction opposite to that of tthe propellers on the other side of the aircraft.

* * * * *